United States Patent [19]

Wellman

[11] Patent Number: 5,038,599

[45] Date of Patent: Aug. 13, 1991

[54] BALL LOCK PUNCH RETAINER

[75] Inventor: Charles G. Wellman, Novi, Mich.

[73] Assignee: AIP Inc., Troy, Mich.

[21] Appl. No.: 506,773

[22] Filed: Apr. 10, 1990

[51] Int. Cl.[5] ..... B21D 37/04; B26D 7/26

[52] U.S. Cl. ..... 72/481; 72/462; 83/698; 279/30; 279/76; 279/79

[58] Field of Search ..... 72/462, 481, 46; 83/698, 686; 279/22, 30, 76, 79

[56] References Cited

U.S. PATENT DOCUMENTS

| | | | |
|---|---|---|---|
| 2,089,166 | 8/1937 | Reichhardt | 279/30 |
| 2,105,391 | 1/1938 | Almdale | 72/481 |
| 2,160,676 | 5/1939 | Richard | 279/76 |
| 2,166,559 | 7/1939 | Richard | 279/30 |
| 2,348,380 | 5/1944 | Graham | 279/76 |
| 2,580,930 | 1/1952 | Kost | 279/79 |
| 3,126,776 | 3/1964 | Whistler, Sr. et al. | 83/698 |
| 3,563,124 | 2/1971 | Gargrave | 83/698 |
| 3,589,226 | 5/1971 | Shadowens, Jr. | 83/143 |
| 4,558,620 | 12/1985 | Wallis | 279/79 |

OTHER PUBLICATIONS

"Techniques of Pressworking, Sheet Metal" Donald Eary and Edward Reed, 1974, pp. 332–334.

*Primary Examiner*—David Jones
*Attorney, Agent, or Firm*—Dykema Gossett

[57] ABSTRACT

An improved punch retainer is disclosed in which a backing plate extends over a relatively large surface area to dissipate force from a punch. A punch retainer body and the backing plate are permanently connected to each other and include passages which are finally ground after the two have been permanently connected. With this arrangement, it is ensured that passages within the backing plate and retainer body are all properly aligned during formation of the punch retainer. Since the backing plate dissipates force over a relatively large surface area, the punch retainer may be used in heavier applications than prior art punch retainers. A spring passage is closed off by a seal received in the backing plate, allowing the use of standard springs.

11 Claims, 1 Drawing Sheet

BALL LOCK PUNCH RETAINER

BACKGROUND OF THE INVENTION

The present invention relates to an improvement in punch retainers for use in a punch and die assembly.

Punch retainers are used in the prior art to retain a punch in a die shoe when the punch is moved to form an aperture in a sheet of metal. Typically, ball-lock punch retainers spring-bias a ball into a notch in the punch. In many prior art retainers a backing plate is attached, using screws or other non-permanent methods, to a retainer body to dissipate reactive forces from the punch down it is forced into a piece of metal, to form an aperture in the metal. These prior art retainers include a number of passages through which dowels extend to properly align the punch retainer with an upper die shoe of a punch and die assembly. Problems are encountered with this type of prior art retainer since the retainer body is connected to the backing plate after formation of the individual parts. The various passages that extend through the retainer body and the backing plate are often improperly aligned and require close attention by an operator to assemble the punch retainer to a die shoe, which is inefficient. There is often waste since a particular backing plate may not be utilized with a particular punch retainer if the passages in the two can not be properly aligned.

Some prior art punch retainers solved this problem by eliminating the backing plate. An example of such a prior art retainer is illustrated in U.S. Pat. No. 3,563,124. In this patent, a plug is utilized in place of a backing plate to dissipate the force received from the punch. The force-dissipating plug must be aligned with the rear of the punch so that the reactive force transmitted into the punch will be transmitted into the plug. This patent addressed the alignment problem inherent in the previously discussed prior art by having a dowel aligned with the punch extend through the plug and into the die shoe. By eliminating the backing plate, the problem of achieving a number of properly aligned passages through both a retainer body and a backing plate is eliminated. A similar device is shown in U.S. Pat. No. 3,589,226.

Problems are still encountered with this type of punch retainer. The forces that must be dissipated from the punch are often of relatively large magnitude, and the plugs disclosed in the above-mentioned patents extend for a relatively small surface area. These plugs sometimes may not adequately dissipate a force, since they do not extend over an adequate surface area.

In addition, prior art retainers are also impractical since it is difficult to secure the spring which biases the ball into a spring passage. Special springs are often required which are more expensive than standard springs.

It is an object of the present invention to disclose a punch retainer which utilizes a backing plate such that an adequate surface area is achieved for force-dissipating means; at the same time not requiring alignment of passages within a retainer body and a backing plate when attaching the punch retainer to a die shoe. In addition, the present invention discloses a punch retainer that does not require special springs to bias the ball into the punch.

SUMMARY OF THE INVENTION

The present invention discloses a punch retainer having a punch retainer body integrally connected to a backing plate by welding, riveting, adhesives, chemical bonding, or any other permanent connections. The passages within the backing plate and the retainer body are finally ground after the two have been integrally attached to ensure that the passages are aligned. The backing plate also includes a spring hole providing access to a spring passage. The spring hole is normally sealed by a screw or plug. By sealing the spring hole, standard springs without special attachment structure can be utilized.

In a preferred embodiment of the present invention, a punch is retained within a punch retainer passage in a pentagonal-shaped retainer body. The backing plate overlies the punch retainer passage and the punch abuts the backing plate. A dowel passage, of smaller diameter than the punch retainer passage, is aligned above the punch retainer passage in the backing plate, and receives a dowel to properly position the punch retainer upon a die shoe. Since the dowel passage is of smaller diameter than the punch retainer passage, a force transmitted from the punch rearwardly is passed into the backing plate. The backing plate is preferably of approximately the same shape as the retainer body, and includes a surface area approximately equal to the surface area of the retainer body, to provide sufficient area for dissipating the force.

In forming the punch retainer of the present invention, the backing plate and the retainer body are initially formed into their general shape. They are then permanently connected, such as by welding or riveting. Passages within the two are then finally ground such that they are properly aligned. The final punch retainer can then be connected to a die shoe.

When a shaped punch is utilized, a diamond pin passage may be formed in the backing plate such that the punch may be properly radially positioned upon the punch shoe. In the present invention the diamond pin passage is formed in the backing plate, while a diamond pin clearance passage is formed in the retainer body. In the prior art, the clearance passage was formed in the backing plate, while the pin passage was formed in the retainer body.

These and other objects and features of the present invention will be understood from the following specification and drawings, of which the following is a brief description.

DETAILED DESCRIPTION OF A PREFERRED EMBODIMENT

Figure 1:
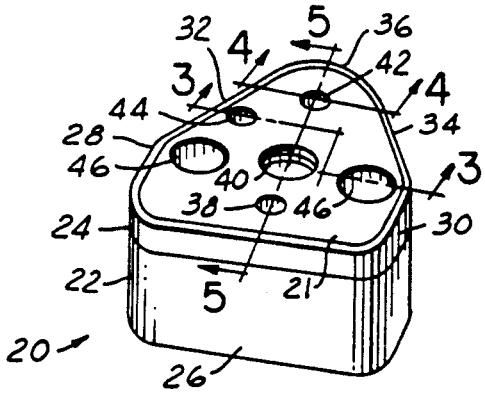
FIG. 1 is a top perspective view of a punch retainer according to the present invention.

Punch retainer 20 has a top face 21, illustrated in FIG. 1, and retainer body 22 with integrally connecting backing plate 24. Punch retainer 20 is of a generally pentagonal-shape and is defined by back 26, opposed rear side portions 28 and 30, and opposed front side portions 32 and 34, which extend inwardly to tip 36. Top face 21 has diamond pin passage 38, spring hole 40, dowel pin passage 42, second dowel pin passage 44, and two cap screw passages 46.

Figure 2:
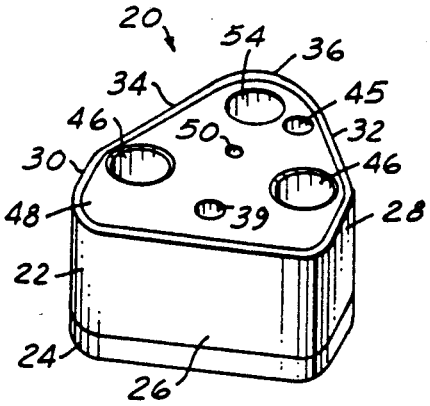
FIG. 2 is a bottom perspective view of the punch retainer illustrated in FIG. 1.

FIG. 2 shows a bottom face 48 of punch retainer 20. Bottom face 48 includes access hole 50, punch retainer passage 54, dowel pin clearance passage 45, diamond pin clearance passage 39 and cap screw passages 46.

Figure 3:
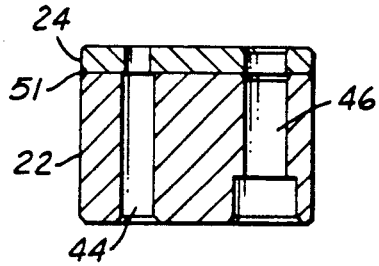
FIG. 3 is a cross-sectional view along lines 3—3 in FIG. 1.

FIG. 3 is a cross-sectional view along lines 3—3 in FIG. 1, and shows weld joint 51 integrally connecting retainer body 22 to backing plate 24. Weld joint 51 forms a bead around the periphery of punch retainer 20. Dowel passage 44 and cap screw passage 46 each extend through backing plate 24. Dowel pin clearance passage 45 is aligned with, and of a greater diameter than, dowel pin passage 44, to provide clearance.

Figure 4:
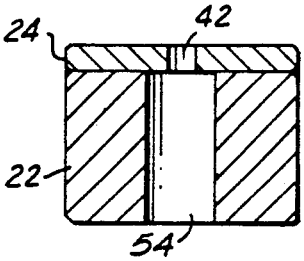
FIG. 4 is a cross-sectional view along lines 4—4 in FIG. 1.

FIG. 4 is a cross-sectional view along lines 4—4 in FIG. 1 and shows dowel pin passage 42 aligned with punch retainer passage 54. A punch is received within punch retainer passage 54 with a rear face in abutting contact with backing plate 24. When the punch is forced relatively into backing plate 24, the force is transmitted into backing plate 24.

Figure 5:
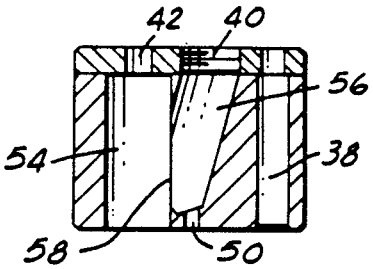
FIG. 5 is a cross-sectional view along lines 5—5 in FIG. 1.

FIG. 5 is a cross-sectional view along lines 5—5 in FIG. 1 and illustrates diamond pin passage 38 and dowel pin passage 42, which is aligned with punch retainer passage 54. Spring hole 40 is formed at one end of angled spring passage 56, which is open to punch retainer passage 54 over intersection area 58. Access hole 50 extends downwardly from spring passage 56 and provides access to release a ball received in spring passage 56. Diamond pin clearance passage 39 is aligned with, and of a greater diameter than diamond pin passage 38 to provide clearance.

Figure 6:
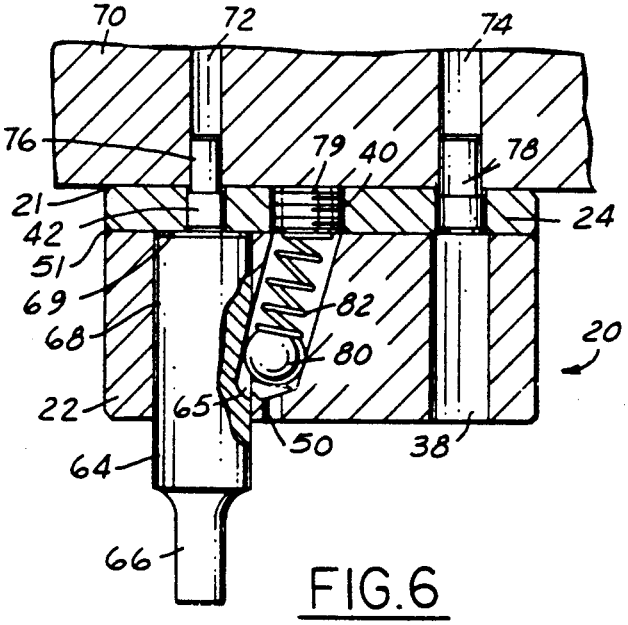
FIG. 6 is a cross-sectional view along lines 5—5 in FIG. 1, but showing the punch retainer assembled to a die shoe.

FIG. 6 shows a punch retainer 20 in an assembled condition. Punch 64 is received in punch retainer passage 54, and has ball retaining notch 65. Punch tip 66 may be of a particular configuration, and may be shaped to vary around the circumference of punch 64. Punch 64 has upper cylindrical body 68 and rear face 69 in abutting contact with backing plate 24.

Punch retainer 20 is mounted below punch shoe 70, which includes passages 72 and 74 to receive dowel pin 76 and diamond pin 78, respectively. Dowel pin 76 and diamond pin 78 properly position punch retainer 20 with respect to punch shoe 70, such that punch 64 is properly aligned with a bottom die shoe. Diamond pin 78 is necessary if punch tip 60 is shaped throughout its circumferential extent. If punch tip 66 is round, it may not be necessary to utilize diamond pin 78, whose primary purpose is to radially align punch 64. Seal 79 is received in spring hole 40 to seal angled spring passage 56. Ball 80 is biased by spring 82 into ball retaining notch 65 to retain punch 64 within punch retainer passage 54. Seal 79 allows a standard spring to be mounted in angled spring passage 56.

In typical punch and die assemblies, punch shoe 70 is moved downwardly, along with punch retainer 20, such that punch 64 is brought into contact with a metal stock, to form an aperture in the metal stock. As punch 64 contacts the metal stock, a force is transmitted rearwardly into rear face 69 of punch 64, and into backing plate 24.

Since backing plate 24 extends for approximately the same area as punch retainer 20, this force is dissipated over a relatively large area. Backing plate 24 is in contact with punch shoe 70 over a relatively large surface area, and thus effectively dissipates the force and transmits it into punch shoe 70 over this surface area.

Since backing plate 24 is permanently connected to retainer body 22, it can be assured that the passages within the two are properly aligned, and that punch retainer 20 will be easily attached to die shoe 70. When forming punch retainer 20, the passages may be initially formed within retainer body 22 and backing plate 24. Backing plate 24 is then permanently connected to retainer body 22 by any permanent connecting means, such as welding or riveting. The passages are then finally ground to ensure that they are properly aligned with each other.

Seal 79, which may be a set screw or a plastic plug of some sort, is inserted into spring hole 40. It is important that seal 79 be easily removed to provide access to angled spring passage 56.

Punch retainer 20 is attached to die shoe 70 in a manner well known in the art. As an example cap screws may pass through cap screw passages 46. As is also well known in the art, across hole 50 allows ball 80 to be released, such that punch 64 may be attached or removed from punch retainer 20. Typically, some tool is inserted into access hole 50 to force ball 80 against the force of spring 82.

Figure 7:
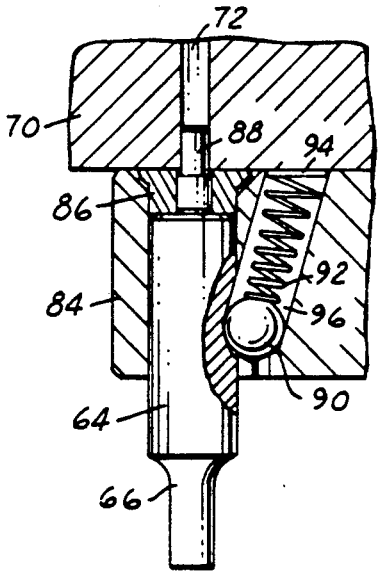
(PRIOR ART) FIG. 7
FIG. 7 is a view similar to FIG. 6, but showing a prior art punch retainer.

Prior art punch retainer 84 is illustrated in FIG. 7 for purposes of comparison. In prior art punch retainer 84, plug 86 receives the force from punch 64. Plug 86 extends for a relatively small surface area and must dissipate the force over this relatively small area. Dowel pin 88 extends through plug 86 and aligns retainer 84 with punch shoe 70. Ball 90 is biased by spring 92 into punch 64. Spring 92 is connected at 94 within passage 96 by some means. Typically, the spring must have some special attachment means to be attached within passage 96.

Punch retainer 20 of the present invention has several benefits over punch retainer 84. First, backing plate 24 extends for a much larger area than plug 86, and thus may dissipate a great deal more force. This allows it to be used in heavier applications than the prior art. In addition, spring passage 56 of the present invention is closed off by seal 79 to allow the use of a standard spring 82. Finally, punch retainer 20 of the present invention achieves the benefits of prior art punch retainer 84, which is to eliminate complicating alignment of retainer body 22 and backing plate 24 with a die shoe.

Since punch retainer 20 is pentagonally-shaped it can be efficiently stored in large quantities. The individual punch retainers 20 nest adjacent each other to make efficient use of space.

It should be understood that while the punch retainer 20 has been disclosed for retaining a punch, the teaching of this invention could also be used for retaining other member. In particular, the teaching could be utilized to retain a punch die, as is also disclosed in U.S. Pat. No. 3,563,124.

A preferred embodiment of the present invention has been disclosed; however, a worker of ordinary skill in the art would realize that certain modifications would be considered within the scope of this invention, and thus the following claims should be studied in order to determine the true scope and content of the present invention.

I claim:

1. A punch retainer comprising:

a retainer body and a backing plate connected thereto, a punch retainer passage formed in said retainer body for holding a punch;

a spring passage formed in said retainer body and backing plate, said spring passage having an intersection area with said punch retainer passage, said spring passage receiving a spring and a ball, said spring biasing said ball into said intersection area for retaining the punch in the retainer passage; and said spring passage extending through the whole extent of said backing plate, a seal removably disposed in the end of said spring passage removed from said intersection located in said backing plate for closing off the end of the spring passage.

2. A punch retainer as recited in claim 1, wherein said backing plate having a dowel passage for holding a locating dowel, said dowel passage being coaxial to, and of a diameter smaller than, said punch retainer passage.

3. A punch retainer as recited in claim 2, wherein said retainer body including a diamond pin clearance passage, a diamond pin passage extending through said backing plate, said diamond pin passage allowing accurate radial positioning of said retainer body and a punch to be held respect to a mating die, said diamond pin clearance passage being of a greater diameter than said diamond pin passage.

4. A punch retainer as recited in claim 1, wherein said retainer body is welded to said backing plate.

5. A punch retainer as recited in claim 1, wherein said seal is a screw.

6. A punch retainer as recited in claim 1, wherein said seal is a plastic plug.

7. A punch retainer, comprising:

a retainer body, said retainer body defining a first surface area;

a backing plate, said backing plate defining a surface area approximately equal to said first surface area of said retainer body, said backing plate being permanently connected to said retainer body;

said retainer body having a punch retainer passage for holding a punch, said backing plate having a dowel passage for holding a locating dowel said dowel passage being of a smaller diameter than said punch retainer passage, said dowel passage being coaxial with said punch retainer passage;

a spring passage being formed in said retainer body, said spring passage intersecting said punch retainer passage over an intersection area, said spring passage receiving a spring and a ball, said spring biasing said ball toward said intersection passage so as to retain said punch in retainer passage, a screw hole at the end of said spring passage remote from said intersection area, said screw hole receiving a seal for closing the end of the spring passage;

said screw hole being formed in said backing plate.

8. A punch retainer as recited in claim 7, wherein said retainer body is welded to said backing plate.

9. A punch retainer as recited in claim 7, wherein said retainer body is pentagonal-shaped.

10. A punch retained as recited in claim 7, wherein said seal is a screw.

11. A punch retainer as recited in claim 10, wherein said seal is a plastic plug.

* * * * *